US008106317B2

(12) United States Patent
Kitazumi

(10) Patent No.: US 8,106,317 B2
(45) Date of Patent: Jan. 31, 2012

(54) ROTARY CONTROL DEVICE

(75) Inventor: Sadaaki Kitazumi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 291 days.

(21) Appl. No.: 12/573,429

(22) Filed: Oct. 5, 2009

(65) Prior Publication Data

US 2010/0083717 A1 Apr. 8, 2010

(30) Foreign Application Priority Data

Oct. 6, 2008 (JP) ..... P2008-259566

(51) Int. Cl.
*H01H 9/28* (2006.01)

(52) U.S. Cl. ..... 200/43.16; 200/318; 200/323; 200/324; 200/325

(58) Field of Classification Search ..... 200/43.01, 200/43.11, 43.13, 43.15, 43.16, 43.18, 566, 200/318, 321–327
See application file for complete search history.

(56) References Cited

U.S. PATENT DOCUMENTS

| | | | | |
|---|---|---|---|---|
| 1,995,909 | A * | 3/1935 | Williams et al. | 70/237 |
| 3,260,808 | A * | 7/1966 | Dimond et al. | 200/43.15 |
| 4,154,125 | A * | 5/1979 | Frank | 74/553 |
| 5,541,379 | A * | 7/1996 | Kim | 200/566 |
| 5,998,743 | A * | 12/1999 | Unkel | 200/43.11 |
| 7,038,148 | B2 * | 5/2006 | Shirakawa | 200/43.11 |
| 7,342,189 | B2 * | 3/2008 | Bravard et al. | 200/43.08 |
| 7,541,553 | B2 * | 6/2009 | Meyer et al. | 200/318 |

FOREIGN PATENT DOCUMENTS

JP 7-335076 12/1995

* cited by examiner

*Primary Examiner* — Michael Friedhofer
(74) *Attorney, Agent, or Firm* — Morgan, Lewis & Bockius LLP

(57) ABSTRACT

A rotary control device includes a body, a knob rotatably provided on the body, a push button provided on a side portion of the knob so as to be depressed, a lock member that moves in response to a depressing operation of the push button, and a lock portion provided in the body. The lock member is retained to the lock portion of the body so as to restrain a rotary operation of the knob before the push button is depressed. When the push button is depressed, the lock member is moved to a space where the lock member is movable in conjunction with the rotary operation of the knob so that a restraint of the rotary operation of the knob is released.

3 Claims, 4 Drawing Sheets

ROTARY CONTROL DEVICE

BACKGROUND

The present invention relates to a rotary control device having a lock function.

Conventionally, there exist, for example, rotary switches as rotary control devices. In this rotary switch, a knob is provided on a body, which incorporates therein a switch main body such as a pair of contacts, so as to be rotated. The switch main body is actuated by rotatably operating the knob (for example, refer to JP-A-7-335076).

However, the conventional rotary switch does not have a lock function for restraining a rotary operation of the knob. Therefore, the knob can be freely rotated, thereby erroneous operations may occur easily. In particular, in such a situation that the rotary switch is provided in a location where the switch is often subjected to a touch by a hand of an user (a driving person) as on an upper face portion of a console box disposed between a driver's seat and a front passenger's seat in a vehicle, there is a higher possibility that such erroneous operations of the rotary switch occur.

On the contrary to the conventional rotary switch described above, there have also been provided rotary switches which become operative only when a knob is depressed once in an axial direction of the knob and then is rotated. This type of rotary switch cannot be rotated as long as the knob is once depressed in the axial direction of the knob. In short, the rotary switch includes a lock function to keep the knob restrained from being rotated as long as the knob is not depressed once in the axial direction of the knob.

In the case of this type of rotary switch, however, when the knob is rotated, the whole of the knob has to be depressed once in the axial direction. Therefore, the operability of the rotary switch is deteriorated since the whole of the knob has to be depressed for rotary operation.

SUMMARY

The invention has been made in view of the situations described above, and an object thereof is to provide a rotary control device which includes a lock function to lock a knob to restrain the rotary operation of the knob with good operability.

In order to achieve the above object, according to the present invention, there is provided a rotary control device, comprising:

a body;

a knob rotatably provided on the body;

a push button provided on a side portion of the knob so as to be depressed;

a lock member that moves in response to a depressing operation of the push button; and a lock portion provided in the body, wherein the lock member is retained to the lock portion of the body so as to restrain a rotary operation of the knob before the push button is depressed; and wherein when the push button is depressed, the lock member is moved to a space where the lock member is movable in conjunction with the rotary operation of the knob so that a restraint of the rotary operation of the knob is released.

According to the rotary control device described above, the knob is restrained from being rotated until the push button is depressed, and the restraint of the rotary operation of the knob is released when the push button is depressed. The rotary control device includes a lock function to restrain the rotary operation of the knob, and a necessary operation to release the restraint of the rotary operation of the knob is only to depress the push button. The push button can be depressed by fingers of the hand of the driver who grips the knob, and following this operation, the knob can be rotated. Consequently, compared with the conventional rotary switch in which the knob is rotated after the whole of the knob is completely depressed, the operability can be improved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, an embodiment (an example) in which the invention is applied to a rotary switch will be described by reference to the drawings.

Figure 1:
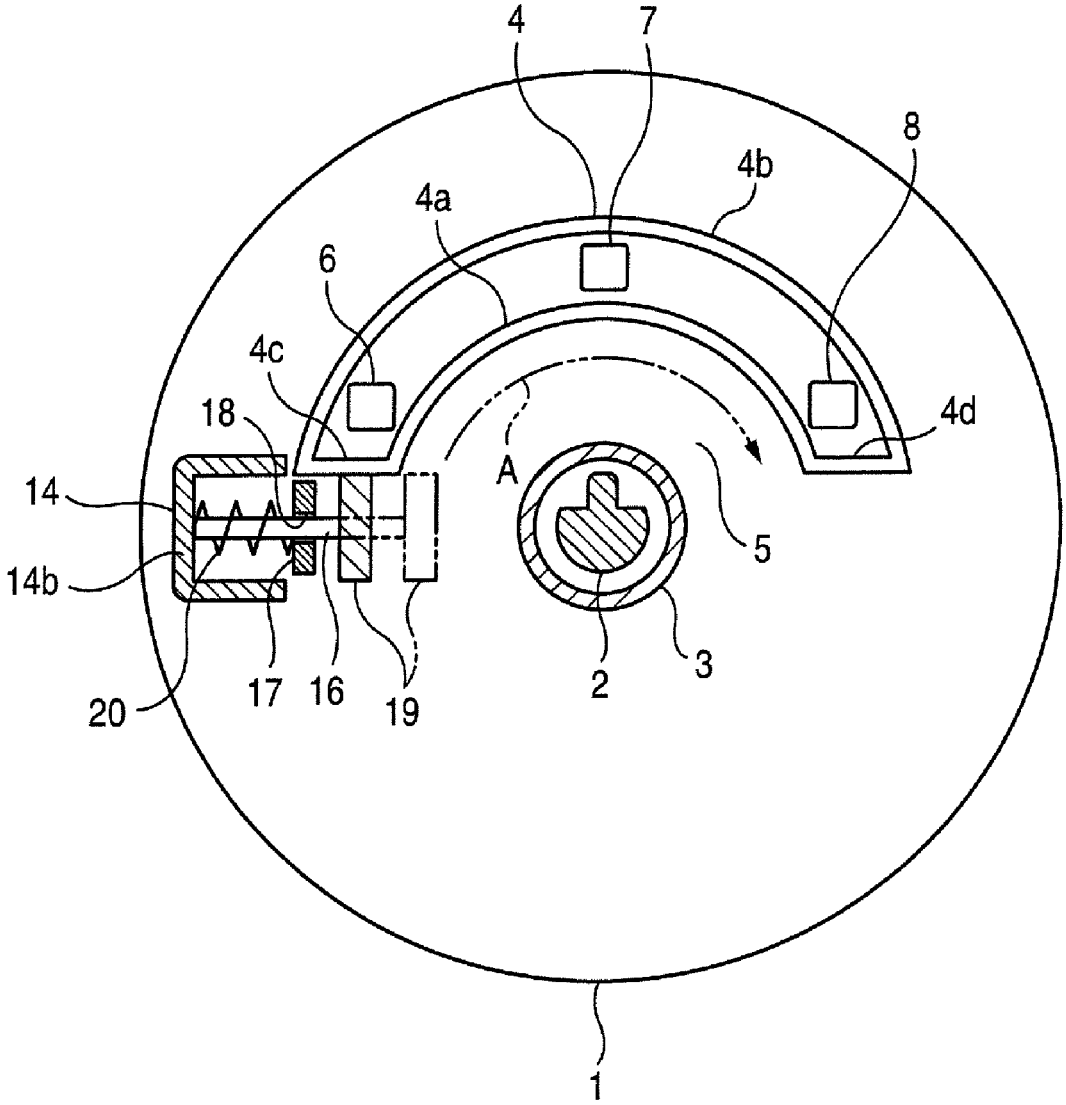
FIG. 1 is a plan view of an overall configuration excluding a knob according to one embodiment of the invention.

Firstly, FIG. 1 shows a body 1 of a rotary switch, and the body 1 has a rotatable shaft 2 at a central portion thereof and a guide cylinder 3 arranged around the periphery of the shaft 2. As shown in FIG. 1, a light guide wall 4 is provided so as to surround an upper half portion of the guide cylinder 3. Specifically, the light guide wall 4 includes a double wall having a semi-arc-like inner wall 4*a* and a similar semi-arc-like outer wall 4*b*. The inner and outer walls 4*a*, 4*b* are closed at both end portions thereof by end walls 4*c*, 4*d*, so that the light guide wall 4 is formed into a hollow shape which is centered at the shaft 2. As a result, a semi-arc-like space 5 is formed between the inner wall 4*a* of the light guide wall 4 and the guide cylinder 3. Consequently, the light guide wall 4 is provided on the body 1 so as to form the semi-arc-like space 5 between the guide cylinder 3 and the light guide wall 4.

Figure 2:
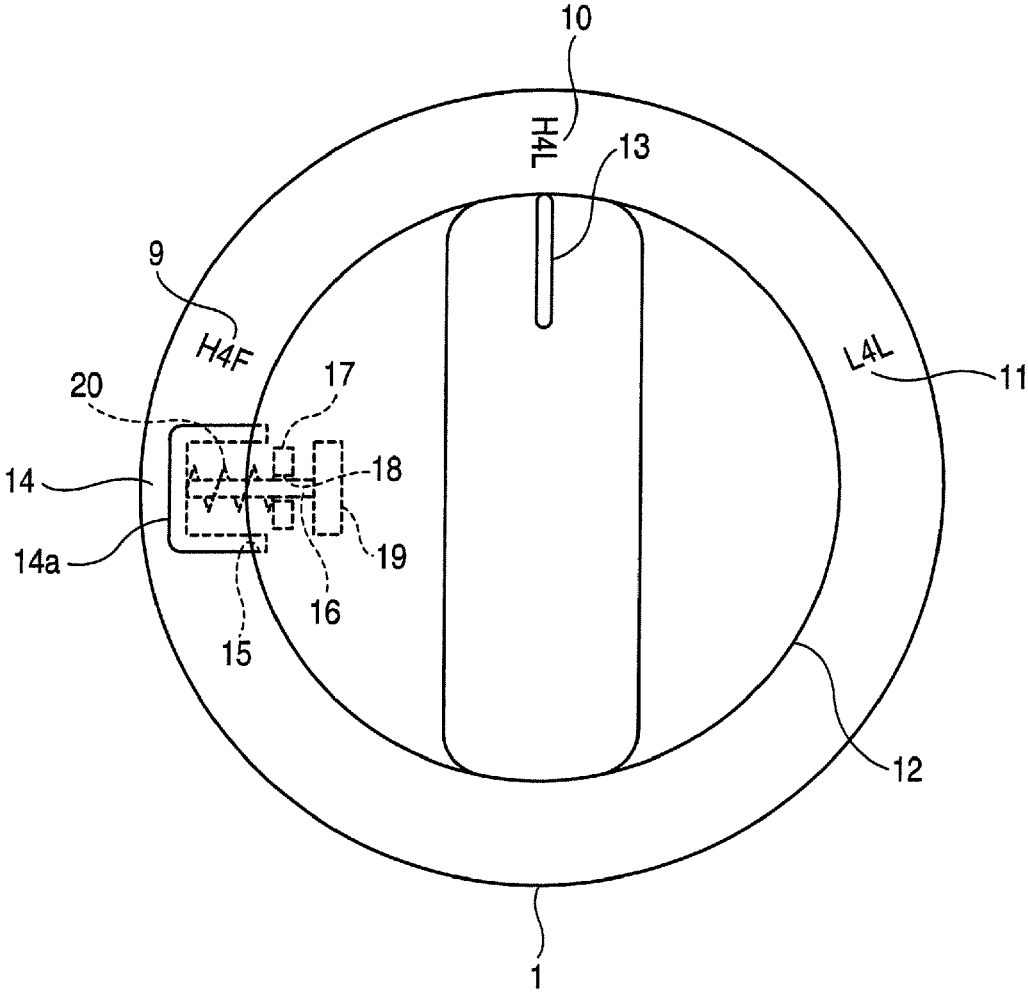
FIG. 2 is a plan view of the overall configuration including the knob according to the embodiment.

In addition, the body 1 incorporates therein a switch main body (not shown) such as a pair of contacts, and in this case, LEDs 6, 7, 8, which are all light emitting devices, are installed in three locations of the guide wall 4, that is, two end portions and one intermediate portion in an interior of the guide wall 4. Additionally, necessary indications 9, 10, 11 are provided on an outer face of the body so as to correspond to the LEDs 6, 7, 8 as shown in FIG. 2. The indications 9, 10, 11 all have light transmitting properties and are illuminated by the LEDs 6 to 8, respectively. Thus, although not illustrated in more detail than described above, the light guide wall 4 is extended diametrically to cover the portions where the indications 9, 10, 11 are provided so as to guide light emitted by the LEDs 6 to 8 to the portions where the indications 9 to 11 are provided.

FIG. 2 also shows a knob 12 of the rotary switch. The knob 12 has a disc shape and is mounted on the shaft 2 at a central portion thereof. As shown in FIG. 2, the knob 12 has an index marking 13 at an upper portion thereof. Also, a push button 14 is provided on a side portion (in particular, at a left lateral side portion) of the knob 12. The push button 14 is inserted into an interior of the knob 12 through a hole 15 formed in the lateral side portion of the knob 12 so that an outer portion 14*a* of the push button 14 is projected outwards of the knob 12, whereby the push button 14 is operable to be depressed from the outside.

Figure 3:
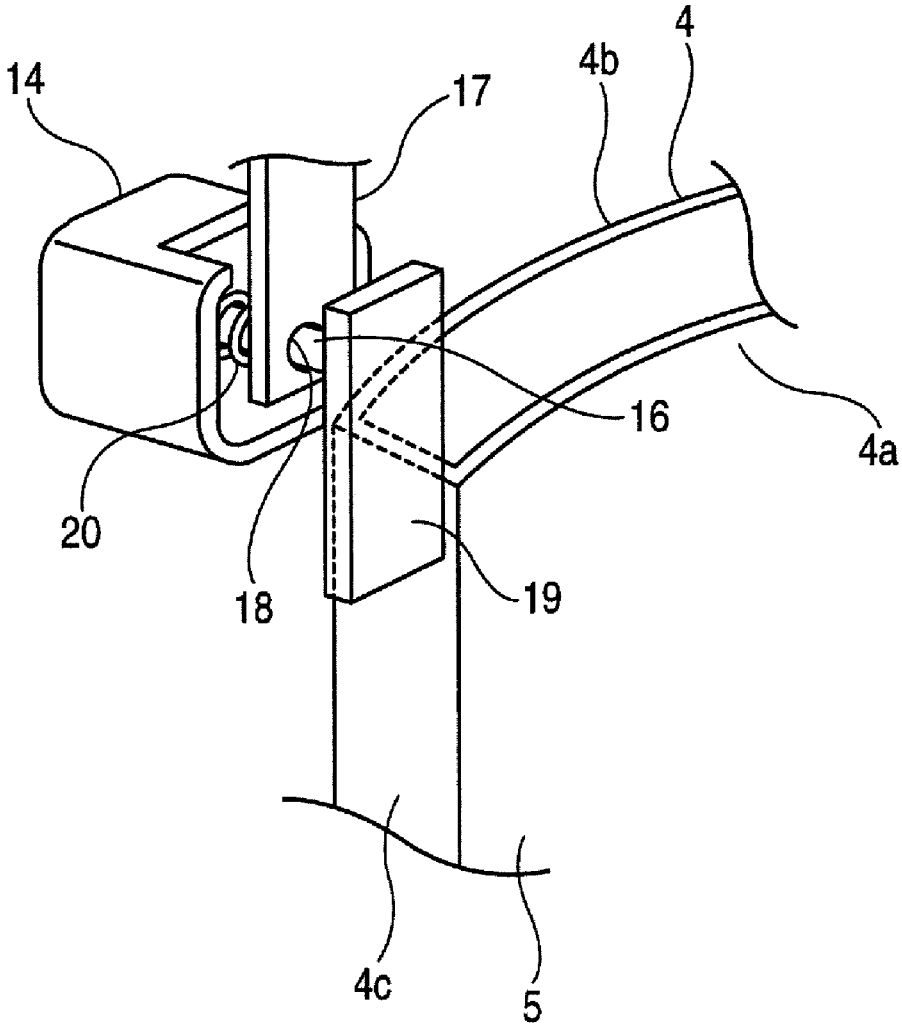
FIG. 3 is a perspective view of a main part which shows a state in which the knob is restrained.

In addition, as shown in FIG. 3, a rod 16 is extended from the push button 14. The rod 16 is passed through a hole 18 in a spring seat 17 provided within the knob 12, and a lock member 19 is attached to a distal end portion of the rod 16. In this case, the rod 16 has a pin-like shape. A spring 20 is interposed between the spring seat 17 and the push button 14 to thereby urge the push button 14 to the outside of the knob 12, and as this occurs, the lock member 19 is positioned to contact in abutment with or extremely close to the left end wall 4*c* of the light guide wall 4 in the body 1.

By the configuration of the above rotary switch, when the knob 12 is attempted to be rotated clockwise without the push button 14 is depressed, the lock member 19 is retained on the end wall 4*c* of the light guide wall 4 in the body 1, whereby the rotation of the knob 12 is locked, and hence, there occurs no case where the knob 12 rotates. In other words, the knob 12 is locked to restrain the rotary operation of the knob 12 and the light guide wall 4 functions as a lock portion which restrains the rotation of the knob 12 with the lock member 19.

Figure 4:
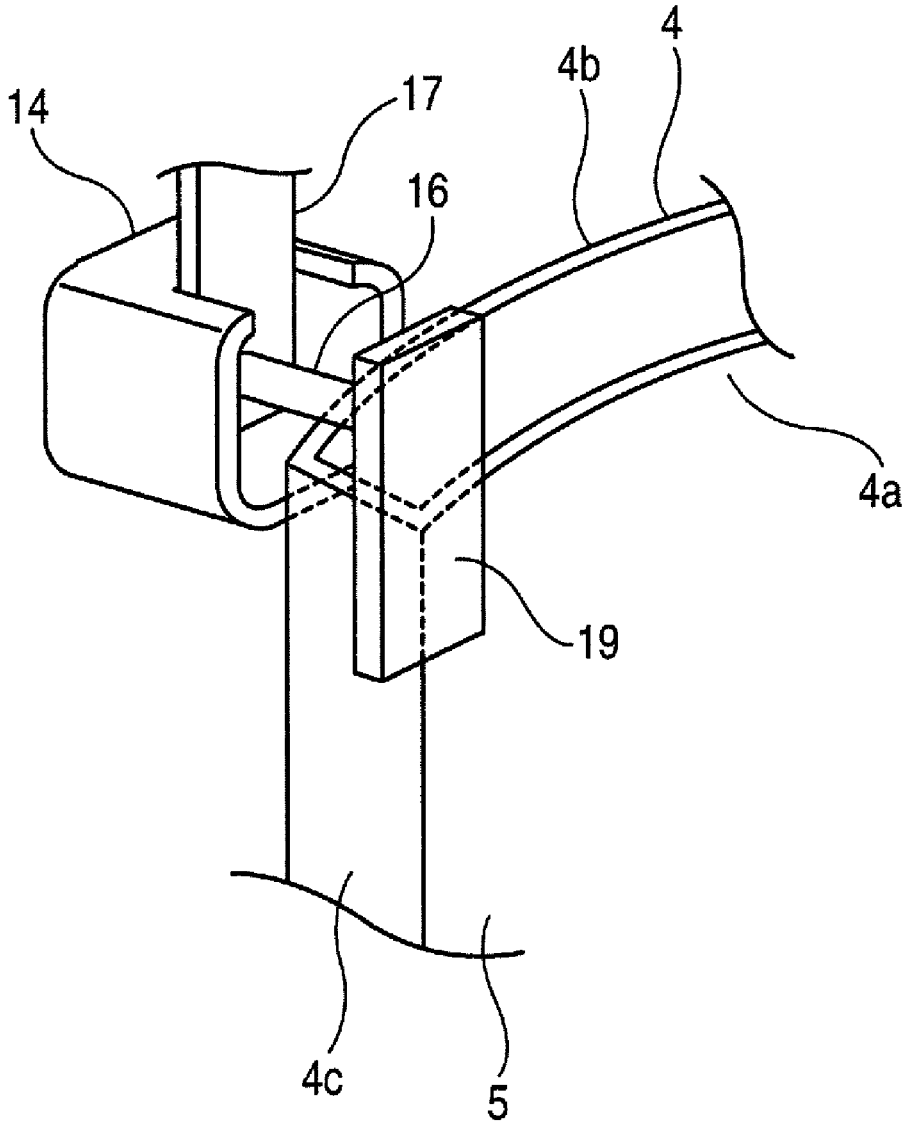
FIG. 4 is a perspective view of the main part which shows a state in which the restraint of the knob is released.

On the contrary to the above operation, when the knob 12 is gripped with fingers of the hand of the driving person and the push button 14 is depressed with the fingers, as shown in FIG. 4 and indicated by a chain double-dashed line in FIG. 1, the lock member 19 moves from a position where the lock member 19 is in abutment with the end wall 4*c* of the light guide wall 4 to a position where the lock member 19 is positioned in the space 5 of the body 1. Then, since the space 5 is formed into the semi-arc-like shape which is centered at the shaft 2, the lock member 19 can move circumferentially in the space 5 along with the rotation of the knob 12, such that the restraint of the knob 12 is released. Consequently, when the knob 12 is rotated clockwise while the restraint of the knob 12 is released, the knob 12 is rotated while the lock member 19 move circumferentially in the space 5 as indicated by an arrow A.

Since the knob 12 is rotated as described above, the indications 9, 10, 11 on the body 1 are indicated sequentially by the index marking 13. In this case, a switching of the driving torque of a vehicle, in particular, a four-wheel-drive vehicle is conducted by the rotating operation of the knob 12. Consequently, the indications 9, 10, 11 indicate driving torque switching modes of the four-wheel-drive vehicle, and an appropriate sensation of a detent (a clicking) is applied to the knob 12 at each of the indications by a detent mechanism (not shown).

When the knob 12, which has been rotated, is rotated in a reverse direction to return to an initial position, the lock member 19 is returned from the position where the lock member 19 is positioned in the space 5 of the body 1 to the position where the lock member 19 is in abutment with the end face 4*c* of the light guide wall 4 by the spring force of the spring 20. As result, the knob 12 returns to the state in which the knob 12 is locked to restrain the rotary operation of the knob 16. At the same time, the push button 14 also returns to the state in which the outer portion 14*a* projects outwards of the knob 12.

In the above rotary switch according to this embodiment, the knob 12 is locked to restrain the rotary operation of the knob 12 before the push button 14 is depressed. When the push button 14 is depressed, the restraint of the rotary operation of the knob 12 is released. Consequently, the rotary switch includes the lock function to restrain the rotary operation of the knob 12, and the necessary operation to release the restraint of the rotary operation of the knob 12 is only to depress the push button 14 provided at the side portion of the knob 12. Therefore, the depressing operation can be implemented by the fingers of the hand with which the knob 12 is gripped, and the depressing operation is followed by the rotating operation of the knob 12. Consequently, compared with the conventional rotary switch in which the knob is rotated after the whole of the knob is completely depressed once, the operability of the rotary switch according to this embodiment can be improved.

The application of the invention is not limited to the rotary switch. In addition, the lock portion may be made up of a portion or a member other than the light guide wall 4.

The invention is not limited only to the embodiment described and illustrated above but can be modified as required for enforcement of the invention without departing from the spirit and scope thereof.

The present application is based on Japanese Patent Application No. 2008-259566 filed on Oct. 6, 2008, the contents of which are incorporated herein for reference.

What is claimed is:

1. A rotary control device, comprising:

a body;

a knob rotatably provided on the body;

a push button provided on a side portion of the knob so as to be depressed;

a lock member that moves in response to a depressing operation of the push button; and a lock portion provided in the body, wherein the lock member is retained to the lock portion of the body so as to restrain a rotary operation of the knob before the push button is depressed; and wherein when the push button is depressed, the lock member is moved to a space where the lock member is movable in conjunction with the rotary operation of the knob so that a restraint of the rotary operation of the knob is released.

2. The rotary control device according to claim 1, wherein the lock portion forms the space where the lock member is movable along a circumference face of the lock portion.

3. The rotary control device according to claim 1, wherein the lock portion is a light guide portion for guiding a light to an indication provided on the body.

* * * * *